US006862964B2

(12) United States Patent
Chen et al.

(10) Patent No.: US 6,862,964 B2
(45) Date of Patent: Mar. 8, 2005

(54) MULTI-FUNCTIONAL HAND TOOL

(75) Inventors: Yu-Gang Chen, Yongkang (TW); Shu-Hao Yang, Tainan (TW)

(73) Assignee: Far East College, Tainan (TW)

( * ) Notice: Subject to any disclaimer, the term of this patent is extended or adjusted under 35 U.S.C. 154(b) by 40 days.

(21) Appl. No.: 10/636,644

(22) Filed: Aug. 8, 2003

(65) Prior Publication Data

US 2005/0028655 A1 Feb. 10, 2005

(51) Int. Cl.[7] ..... B25B 23/00
(52) U.S. Cl. ..... 81/439; 81/490; 81/177.4
(58) Field of Search ..... 81/439, 436, 443, 81/490, 177.4, 52, DIG. 5; 7/101, 167, 170, 168, 100; 968/139, 170, 398

(56) References Cited

U.S. PATENT DOCUMENTS 910,789 A * 1/1909 Cunningham ..... 81/57.5
1,620,262 A * 3/1927 Klaboe ..... 7/167
2,519,559 A * 8/1950 Foster et al. ..... 7/167
2,788,816 A * 4/1957 Dargols ..... 81/439
D180,643 S * 7/1957 Fitch ..... D8/85
5,186,083 A * 2/1993 Hsiao ..... 81/124.4
D344,664 S * 3/1994 Malkinson ..... D8/85
5,365,811 A * 11/1994 Chi ..... 81/439
5,673,600 A * 10/1997 Yanagi et al. ..... 81/490
5,713,252 A * 2/1998 Iwinski et al. ..... 81/439
6,267,032 B1 * 7/2001 Hsieh ..... 81/177.85
6,273,582 B1 * 8/2001 Taggart et al. ..... 362/119

FOREIGN PATENT DOCUMENTS

GB 2152419 A * 8/1985 ..... B25B/15/02

* cited by examiner

*Primary Examiner*—David B. Thomas

(57) ABSTRACT

A multi-functional hand tool includes a base, an upper cover, a cam, a turning disk, a plurality of tool heads, and an indication unit. The base and the upper cover have a plurality of tracks, respectively. The turning disk is pivotally connected at a lower side of the base. In the tracks at the base and the upper cover are tool heads having distinct styles, and the tool heads are accommodated by springs. A cam is additionally provided between the base and the upper cover. By rotating the turning disk, the cam is driven to push the tool heads and compress the springs, thereby stretching the distinct tool heads out of the tracks for further usage.

4 Claims, 7 Drawing Sheets

MULTI-FUNCTIONAL HAND TOOL

BACKGROUND OF THE INVENTION (a) Field of the Invention

The invention relates to a multi-functional hand tool, and more particularly, to a hand tool comprising a plurality of tool heads having distinct shapes in tracks at a base and an upper cover thereof, so as to provide users with facilitated selection and easy portability as well as economized storage space, thereby accomplishing effects as shortening labor hour and increasing work efficiency.

(b) Description of the Prior Art

General hand tools come in numerous types. For example, there are various specifications and dimensions merely for the commonly used screwdrivers. When dismantling or assembling screws having different sizes, it is then necessary to use screwdrivers having different specifications. Therefore, much time is spent on simply finding appropriate tools, not to mention inconveniences in carrying and spaces for storing these tools. Later the industrialists have proposed a "Pen Screwdriver" disclosed by the Taiwan Patent Publication No. 408657. This prior invention has an accommodating tube at an interior of a main body thereof, and the accommodating tube is for placing tool heads having distinct sizes and shapes. The tool heads having distinct sizes and shapes may be stretched out of the accommodating tube for dismantling and assembling of screws. Referring to the Taiwan Patent Publication No. 433127 disclosing a "Screwdriver Having Rapidly and Readily Replaceable Tool Heads", this prior invention similarly has an accommodating chamber at a screwdriver shaft thereof, and the accommodating chamber is similarly for placing tool heads having distinct sizes and shapes, so as to dismantle and assemble screws having different sizes. However, when using the above hand tools, it is essential that tool heads be replaced by dismantling from a front end and placing in from a rear end of the accommodating tube or accommodating chamber. Suppose a required tool head is near a rear end of the prior structure, quite a number of replacements are needed before acquiring the required tool head. The prior inventions are quite time consuming and are limited to dismantling and assembly of screwdrivers only. However, in common work, not only dismantling and assembly, but also other tasks are involved. For instance, to dismantle and assemble screw nuts and screws bolts, hand tools like socket wrenches are needed. Or, tools like blades are required for tasks of cutting objects. Hence, there are yet many other fundamental and complicated tools, and the aforesaid prior hand tools become hardly satisfactory for all purposes needed. Above, all, ranges of applicability are already confined, thus giving inadequate practicability.

SUMMARY OF THE INVENTION

The primary object of the invention is to provide a multi-functional hand tool capable of offering facilitated selection, easy portability and economized storage space, so as to reduce time need for finding appropriate tools and expanding applicability ranges, thereby accomplishing effects as shortening labor hour and increasing work efficiency.

The invention comprises a base, an upper cover, a cam, a turning disk, a plurality of tool heads, and an indication unit. The base is a polygon, and has a recess at an inner side thereof, a track corresponding to each edge at a periphery of the recess, and a semi-hexagonal exit connected with each track and vertically penetrated through each edge of the base. The upper cover is disposed above the base, is a polygon, and has a recess at an inner side thereof, a track corresponding to each edge at an periphery of the recess, a semi-hexagonal exit connected with each track and vertically penetrated through each edge of upper cover, and an accommodating recess at an upper side thereof. The cam is pivotally connected in the recesses of the base and the upper cover, and has an axis opening, and a projecting propelling portion at a side edge thereof. The turning disk is pivotally connected at a lower side of the base, and has an axis opening, a pivotal axis inserted in the axis opening, and driving portions at the pivotal axis. The plurality of tool heads is disposed in the tracks of the base and the upper cover, and each tool head has a spring accommodated around, a push end at one end thereof, a work end having a distinct shape at the other end thereof. The indication unit is embedded into the recess of the upper cover.

DETAILED DESCRIPTION OF THE PREFERRED EMBODIMENTS

To better understand the invention, a preferred embodiment shall be given with the accompanying drawings hereunder.

Figure 1:
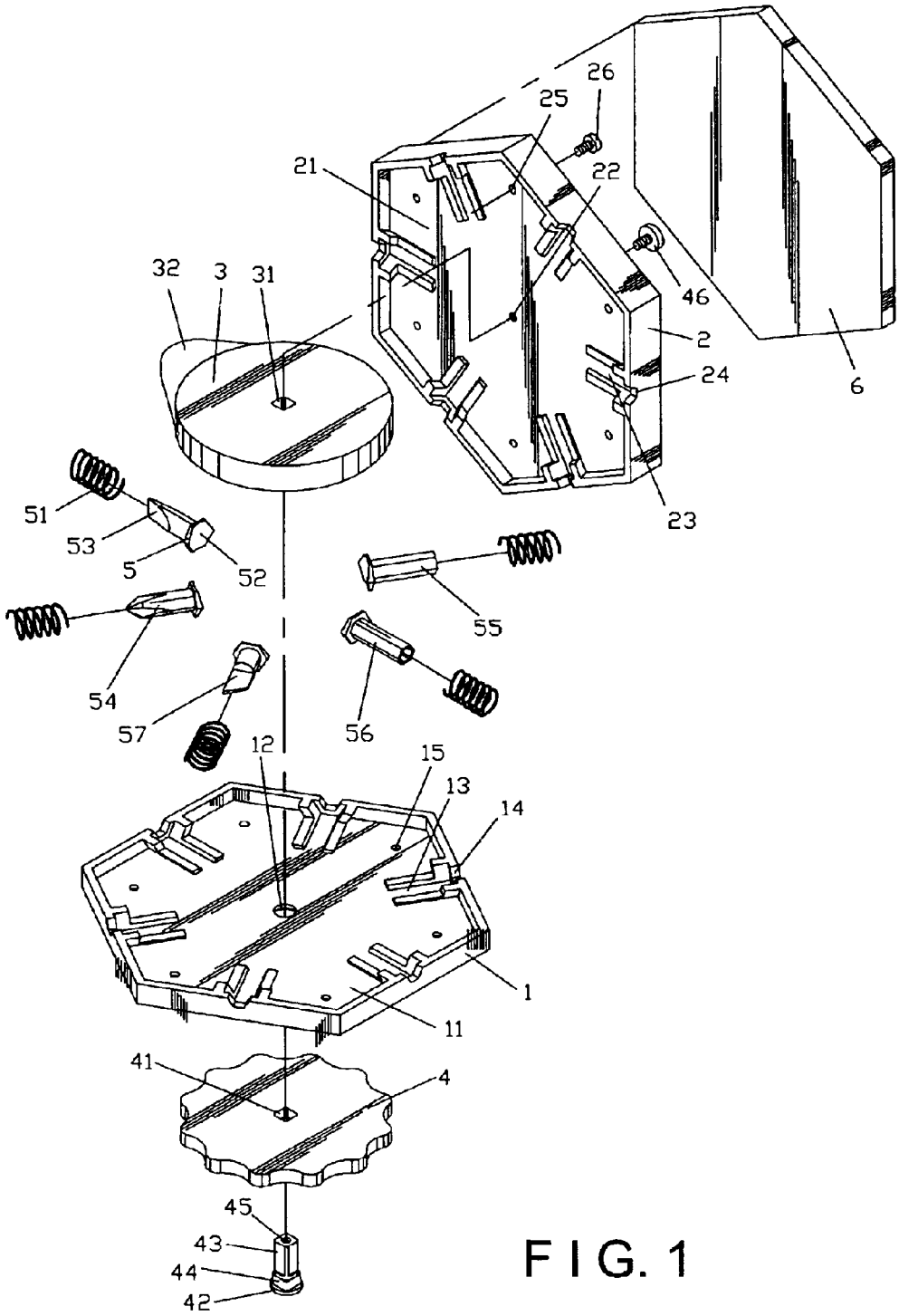
FIG. 1 shows an exploded elevational view according to the invention.
Figure 2:
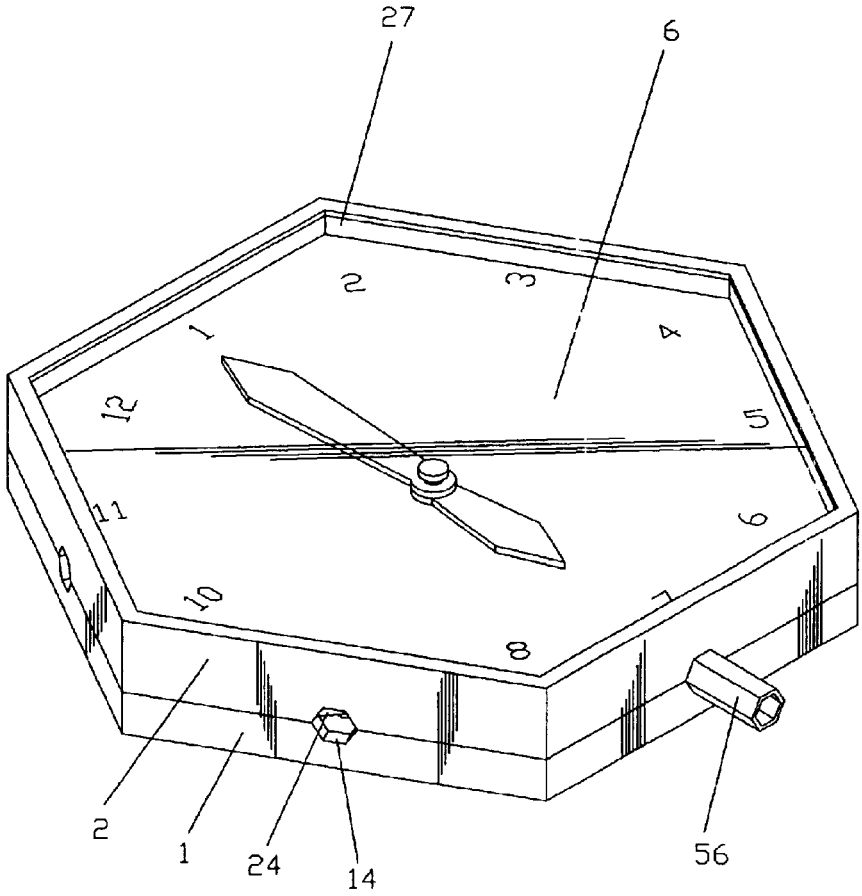
FIG. 2 shows an elevational view according to the invention.

Referring to FIGS. 1 and 2, the invention comprises a base 1, an upper cover 2, a cam 3, a turning disk 4, a plurality of tool heads 5, and an indication unit 6.

The base 1 is a polygon, and has a recess 11 at an inner side thereof, a countersink axis opening 12 at a center of the recess 11, a track 13 corresponding to each edge at an periphery of the recess 11, a semi-hexagonal exit 14 connected with each track 13 and vertically penetrated through each edge of the base 1, and a plurality of screw openings 15 penetrated near the periphery of the base 1.

The upper cover 2 is disposed above the base 1, and has a shape identical to that of the base 1. The upper cover 2 has a recess 21 at an inner side thereof, a countersink axis opening 21 at a center of the recess 21, a track 23 corresponding to each edge at an periphery of the recess 21, a semi-hexagonal exit 24 connected with each track 23 and vertically penetrated through each edge of upper cover 2, wherein hexagonal exits are formed by joining the base 1 and the upper cover 2. The upper cover 2 further has a plurality of screw openings 25 penetrated near the periphery of the upper cover 2, screws 26 inserted into the screw openings 25, and an accommodating recess 27 at an upper side thereof.

The cam 3 is pivotally connected in the recesses 11 and 21 of the base 1 and the upper cover 2, and has a square axis opening 31, and a projecting propelling portion 32 at a side edge thereof.

The turning disk 4 is pivotally connected at a lower side of the base 1, and has a square axis opening 41, a pivotal axis 42 inserted in the axis opening 41, two square driving portions 43 and 44 at the pivotal axis 42, a screw opening 45 at an end facet of the pivotal axis 42, and a screw 46 placed in the screw opening 45.

The plurality of tool heads 5 is disposed, in the tracks 13 and 23 of the base 1 and the upper cover 2. Each tool head 5 has a spring 51 accommodated around, a push end 52 at a rear end thereof, and a work end having a distinct shape at a front end thereof. The work ends include a single-threaded work end 53, a cross work end 54, and a hexagonal work end 55 for dismantling and assembling screws having different shapes. The plurality of tool heads 5 further includes a work end 56 having a socket and a work end 57 having a blade.

The indication unit 6 is embedded into the recess 27 of the upper over 2, and may a clock, a stopwatch, a compass or a text and graphic indication. In this embodiment, the indication unit 6 is a clock.

Figure 3:
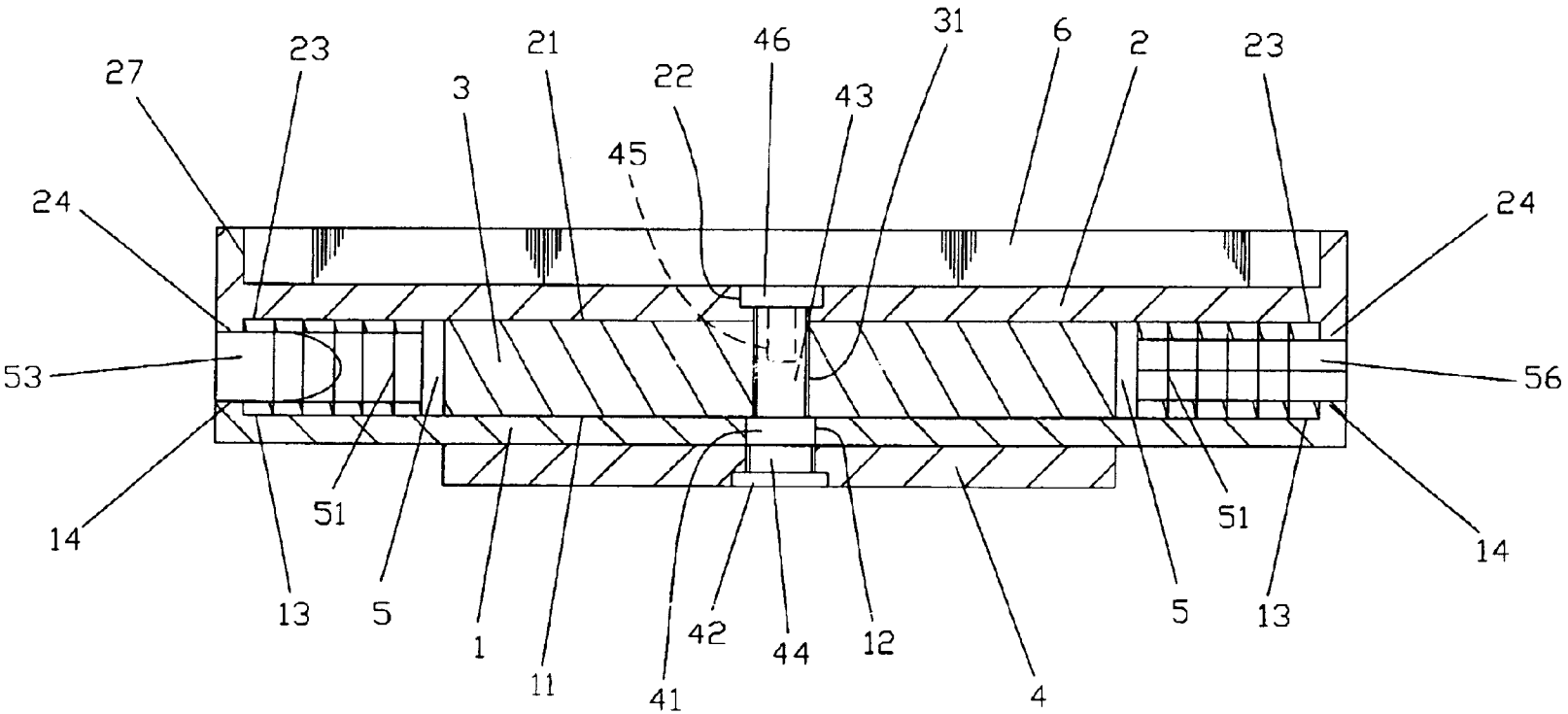
FIG. 3 shows a sectional view according to the invention.

Referring to FIG. 3, to assemble the structure according to the invention, the cam 3 is placed in the recess 11 of the base 1, and the tool heads 5 are disposed in the tracks 13 at the base 1 in sequence, such that the work ends of the tool heads 5 are located at the exits 14, and the springs 51 at the tool heads 5 are butted against adjacent inner walls of the tracks 13 and the exits 14. Wherein, one of the tracks 13 is not provided with any tool head 5. The upper cover 2 and the base 1 are aligned and joined, so that the cam 3 is similarly located in the recess 21 of the upper cover 2, and the propelling portion 32 at the cam 3 is butted into the tracks 13 and 23 without the tool head 5. The turning disk 4 is positioned at an outer side of the base 2, and is penetrated through the axis openings 41, 12, 31 and 22 of the turning disk 4, the upper cover 1, the cam 3 and the base 2 using the pivotal axis 42. The screw 46 is fastened into the screw opening 45, so as to pivotally connect the cam 3 into the recesses 21 and 11 of the upper cover 2 and the base 1. When rotating the turning disk 4, the driving portion 44 at the pivotal axis 42 is driven via the axis opening 41 to further rotate the pivotal axis 42. The cam 3 is of the pivotal axis 42 is driven via the other driving portion 43. The plurality of screws 26 is fastened into the screws openings 25 and 15 of the upper cover 2 and the base 1, so as to join and fasten the upper cover 2 with the base 1. The indication unit 6 is embedded into the accommodating recess 27 of the upper cover 2.

Figure 4:
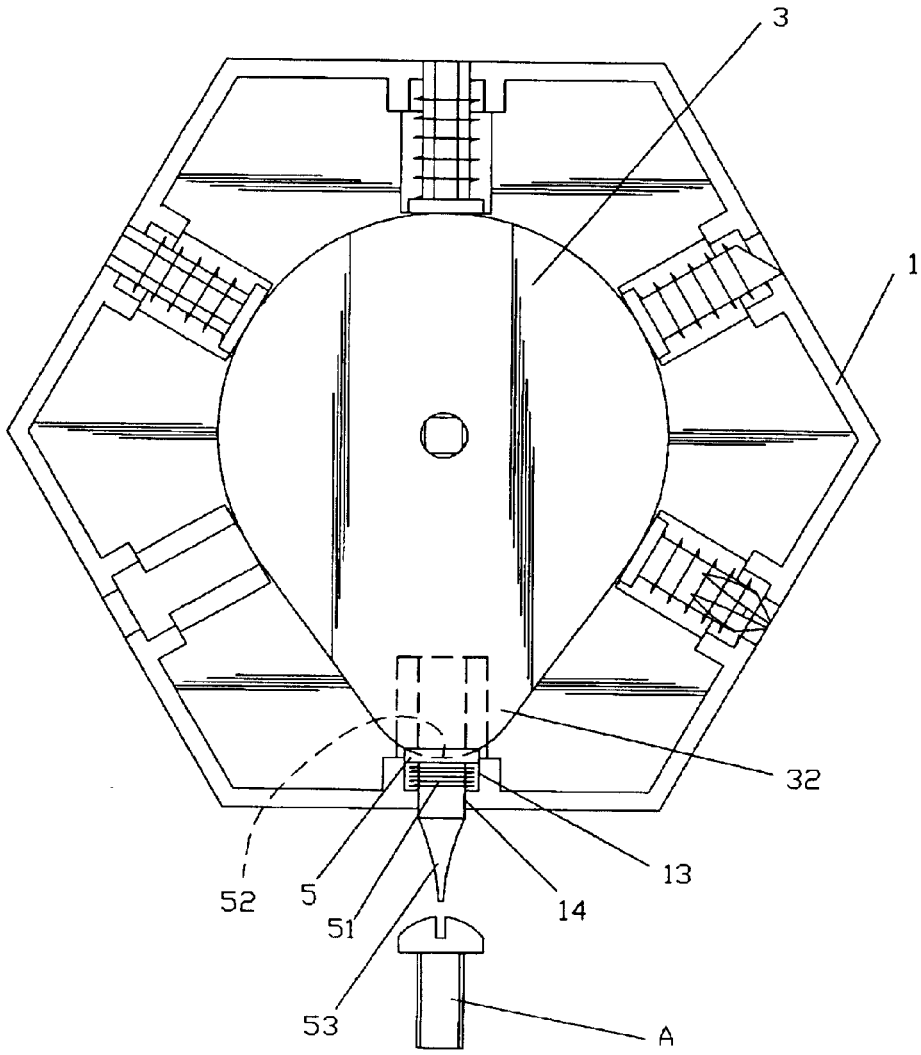
FIG. 4 shows a schematic view illustrating a single-threaded work end being applied according to the invention.
Figure 5:
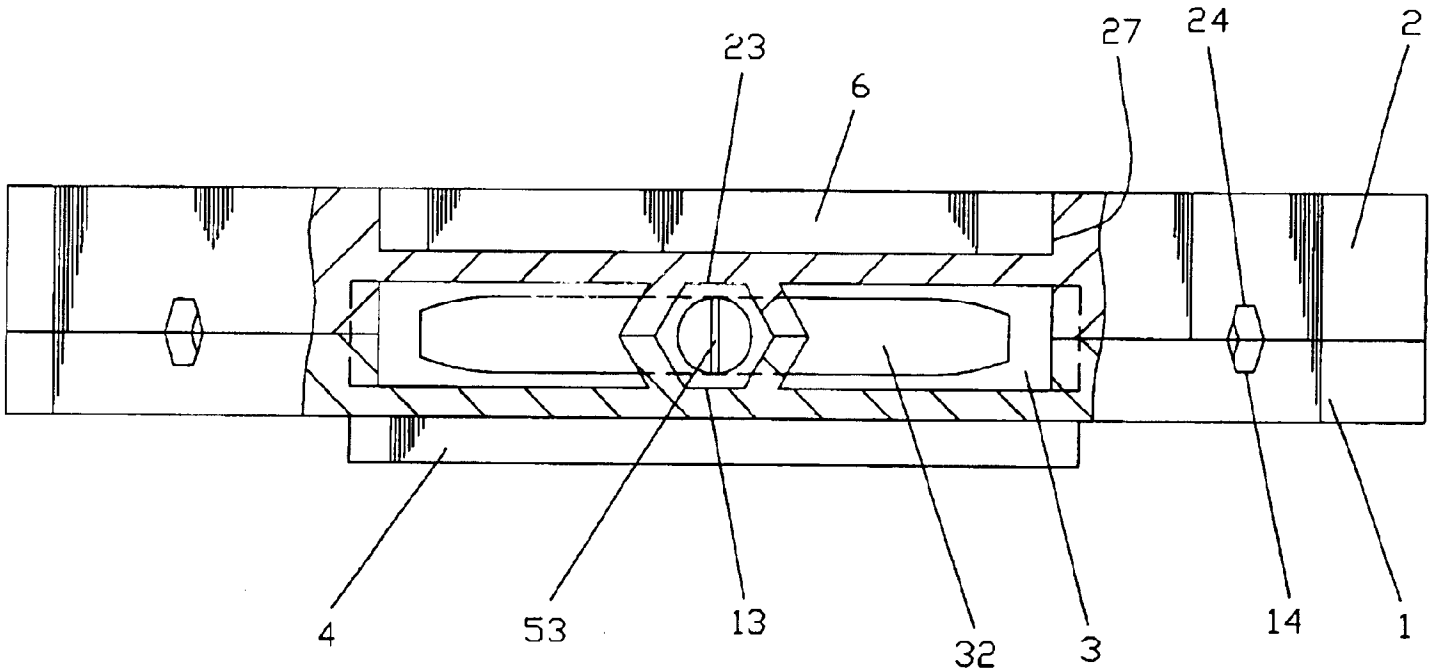
FIG. 5 shows a sectional view illustrating a single-threaded work end being applied according to the invention.
Figure 6:
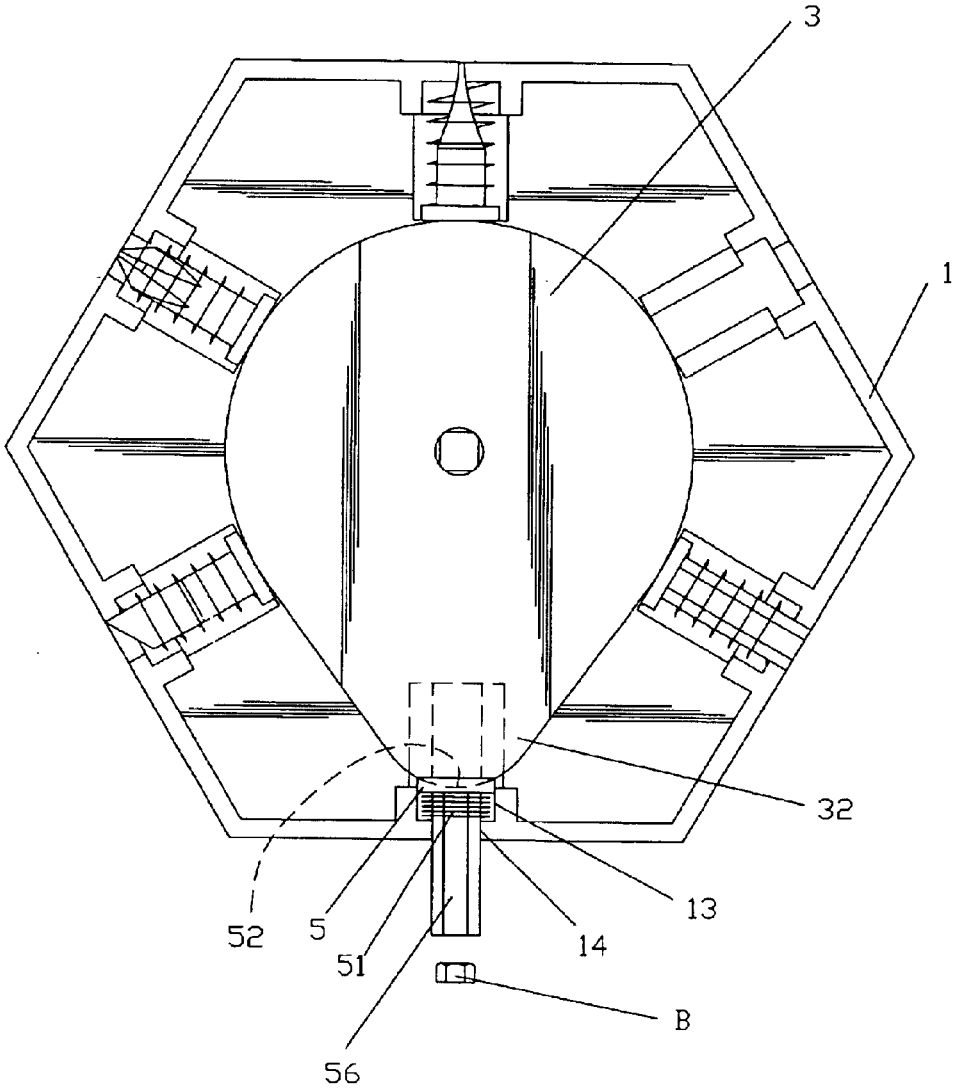
FIG. 6 shows a schematic view illustrating a socket work end being applied according to the invention.
Figure 7:
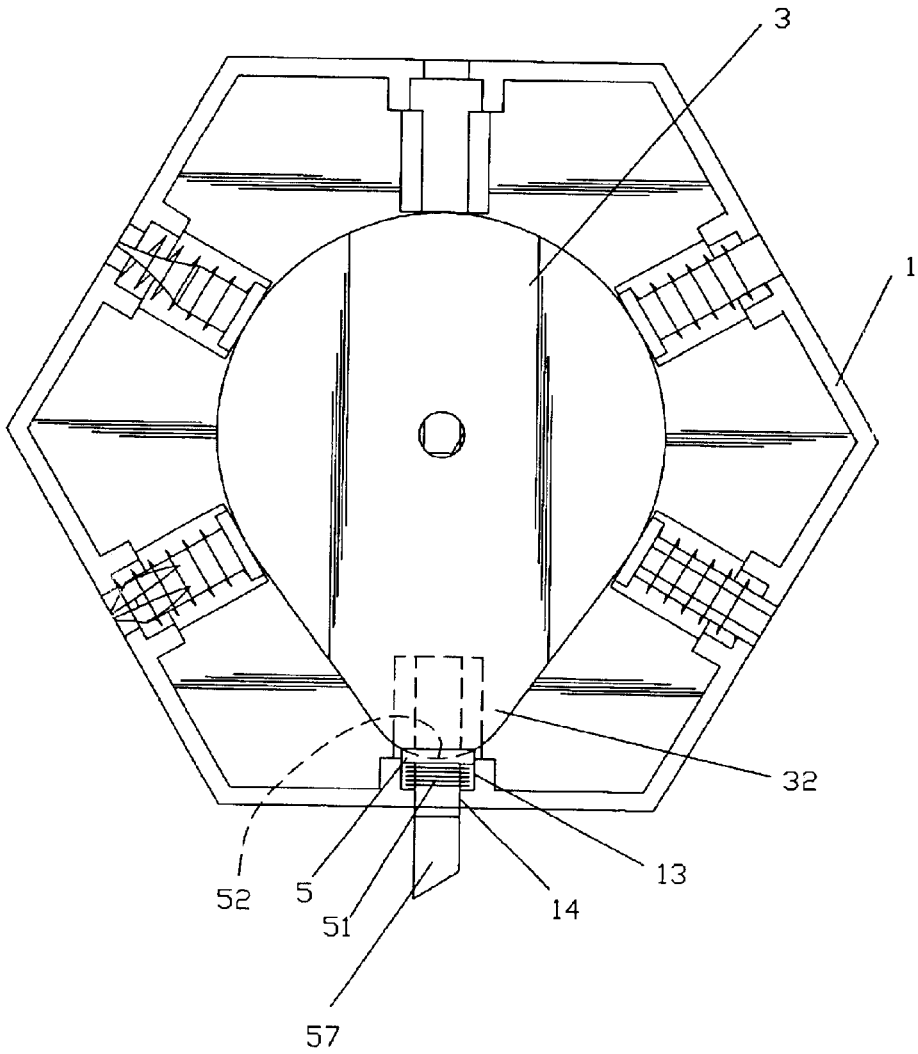
FIG. 7 shows a schematic view illustrating a blade work end being applied according to the invention.

Referring to FIGS. 4 and 5, to put the invention to use for dismantling or assembling a single-threaded screw A, the turning disk 4 is rotated for simultaneously driving the cam 3. When the turning cam 3 reaches one of the tracks 13 and 23, the propelling portion 32 is butted against the push end 52 of the corresponding tool head 5. The push end 52 compresses the spring 51 of the tool head 5, so as to have the work end thereof stretch out from the exits 14 and 24. The turning disk 4 is rotated to a position with the single-threaded work end 53 required being stretched out, the single-threaded work end 53 is vertically placed into an aperture of the single-threaded screw A, and the base 1 and the upper cover 2 are manually rotated. For that the single-threaded work end 53 is a hexagon, and so are the exits 14 and 24 of the base 1 and the upper cover 2, the single-threaded work end 53 is driven and rotated for further loosening and dismantling the screw A. Referring to FIG. 6, to dismantle a screw nut B, only the turning disk 4 is rotated in order to change to another tool head 5 having a different work end. When the tool head 5 having a socket work end 56 is stretched out from the exits 14 and 24, the socket work end 56 is utilized for dismantling the screw nut B. Referring to FIG. 7, to use a blade for cutting purposes, the turning disk 4 is similarly rotated in order to change to another tool head 5 having a different work end. When the tool head 5 having a blade work end 57 is stretched out from the exits 14 and 24, the work end 57 having a blade is utilized for cutting purposes. In addition, the indication unit 6 provides time indication function, and thus a user is kept aware over time.

The invention has the following excellences:

1. The tracks at the base and the upper cover are disposed with a plurality of tool heads having distinct shapes for facilitating selection and usage, hence offering easy portability and economizing storage space.
2. Apart from work ends for dismantling and assembling different screws, the tool heads according to the invention also include a socket work end, a blade work end, and a clock, so as to provide other functions such as dismantling screw nuts, cutting objects and indicating time.
3. The invention is capable of rapidly rotating and selecting an appropriate tool head in order to reduce time needed for finding tools. Furthermore, applicable ranges are expanded for accomplishing shortening labor hour and hence increasing work efficiency.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A multi-functional hand tool comprising a base, an upper cover, a cam, a turning disk, a plurality of tool heads, and an indication unit; wherein:

the base is a polygon, and has a recess at an inner side thereof, a track corresponding to each edge at a periphery of the recess, and a semi-hexagonal exit connected with each track and vertically penetrated through each edge of the base;

the upper cover is disposed above the base, is a polygon, and has a recess at an inner side thereof, a track corresponding to each edge at an periphery of the recess, a semi-hexagonal exit connected with each track and vertically penetrated through each edge of upper cover, and an accommodating recess at an upper side thereof;

the cam is pivotally connected in the recesses of the base and the upper cover, and has an axis opening, and a projecting propelling portion at a side edge thereof;

the turning disk is pivotally connected at a lower side of the base, and has an axis opening, a pivotal axis inserted into the axis opening, and driving portions at the pivotal axis;

the plurality of tool heads is disposed in the tracks of the base and the upper cover, and each tool head has a spring accommodated around, a push end at one end thereof, a work end with a distinct shape at the other end thereof; and the indication unit is embedded into the recess of the upper cover; and the characteristics being that, by rotating the turning disk, the cam is driven for pushing the tool heads and compressing the springs via the pivotal axis, thereby stretching work ends of distinct tool heads out of the exits for further usage.

2. The multi-functional hand tool in accordance with claim 1, wherein the exits of the joined base and upper cover are hexagons.

3. The multi-functional hand tool in accordance with claim 1, wherein the axis opening of the cam is square, and the driving portions are also square, thereby inserting the driving portions into the axis opening of the cam for further driving the cam.

4. The multi-functional hand tool in accordance with claim 1, wherein the indication unit is a clock, a stopwatch, a compass or a text and graphic indication.

* * * * *